US008836687B2

(12) United States Patent
Chen et al.

(10) Patent No.: US 8,836,687 B2
(45) Date of Patent: Sep. 16, 2014

(54) DRIVING METHOD FOR BISTABLE DISPLAY

(75) Inventors: Cho-Yan Chen, Hsin-Chu (TW); Ching-Huan Lin, Hsin-Chu (TW); Tsung-Hsien Hsieh, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 267 days.

(21) Appl. No.: 13/270,223

(22) Filed: Oct. 10, 2011

(65) Prior Publication Data

US 2012/0113081 A1 May 10, 2012

(30) Foreign Application Priority Data

Nov. 10, 2010 (TW) ..... 099138661 A

(51) Int. Cl.

| | |
|---|---|
| ***G09G 5/00*** | (2006.01) |
| ***G09G 3/36*** | (2006.01) |
| ***G09G 3/34*** | (2006.01) |

(52) U.S. Cl.

CPC ..... *G09G 3/3651* (2013.01); *G09G 3/344* (2013.01); *G09G 2300/0486* (2013.01); *G09G 2310/065* (2013.01)

USPC ..... 345/211

(58) Field of Classification Search

None

See application file for complete search history.

(56) References Cited

U.S. PATENT DOCUMENTS

| | | | | |
|---|---|---|---|---|
| 7,019,795 | B2 | 3/2006 | Jones | |
| 8,232,961 | B2 | 7/2012 | Fan et al. | |
| 8,446,396 | B2 | 5/2013 | Lai et al. | |
| 2003/0156089 | A1 * | 8/2003 | Yamakawa et al. | 345/96 |
| 2005/0024353 | A1 | 2/2005 | Amundson et al. | |
| 2007/0126673 | A1 | 6/2007 | Djordjev et al. | |
| 2007/0222928 | A1 * | 9/2007 | Sikharulidze | 349/123 |
| 2009/0153757 | A1 | 6/2009 | Nose | |
| 2009/0179923 | A1 * | 7/2009 | Amundson et al. | 345/690 |
| 2010/0156967 | A1 * | 6/2010 | Watanuki et al. | 345/691 |
| 2010/0309180 | A1 * | 12/2010 | Chang et al. | 345/208 |
| 2011/0128265 | A1 * | 6/2011 | Marhefka et al. | 345/211 |

FOREIGN PATENT DOCUMENTS

| | | | |
|---|---|---|---|
| CN | 101454822 | A | 6/2009 |
| TW | 201037446 | A1 | 10/2010 |
| TW | 201039309 | A1 | 11/2010 |
| WO | 2007138251 | A1 | 12/2007 |

* cited by examiner

*Primary Examiner* — Adam R Giesy
*Assistant Examiner* — Henok Heyi
(74) *Attorney, Agent, or Firm* — Winston Hsu; Scott Margo

(57) ABSTRACT

A driving method for a bistable display device includes setting a first duration and a second duration according to a frame period; applying a first voltage to a light valve layer in the first duration according to display data, so as to transform the light valve layer from a first state to a second state; and applying a second voltage in the second duration to the light valve layer in the second duration for the light valve layer to transform to the first state. Since the light valve layer of the bistable display device is already at the first state prior to displaying the next image, the light valve layer is not required to reset when switching displayed images, hence reducing the total number of frames required to display each image.

12 Claims, 5 Drawing Sheets

DRIVING METHOD FOR BISTABLE DISPLAY

BACKGROUND OF THE INVENTION

1. Field of the Invention

The present invention is related to a driving method for a bistable display device, and more particularly, to a driving method of the bistable display device for reducing a number of frames required when switching images.

2. Description of the Prior Art

Paper is a commonly-used display medium, due to advantages of wide viewing angle, thin and flexible body, and being easy to carry around. Due to popularized printing technology, a user can easily print out a massive amount of data on paper. However, manufacturing paper consumes substantial natural resources, and information on conventional paper is usually not updatable, or can only be updated a limited number of times. Paper-like display devices are gaining popularity, since paper-like display devices possess both the advantages of paper and the updatable property of electronic devices.

Paper-like display devices can be realized with bistable display devices. A bistable display device only consumes power when changing displayed images, and the displayed images can be displayed without applying external voltages. Bistable display devices can be categorized as electrophoretic display devices and cholesteric liquid crystal display devices. A light valve layer of an electrophoretic display device or a cholesteric liquid crystal display device is capable of being in a first state or a second state. For instance, the first state is a bright state and the second state is a dark state.

Taking the electrophoretic display device as an example, in the first state, the light valve layer displays a white substance, and the white substance reflects light to display the bright state. In the second state of the electrophoretic display device, the light valve layer displays a black substance or a colored substance, and the black substance absorbs light to display the dark state, or the colored substance absorbs light to display a colored state.

The cholesteric liquid crystal display device comprises characteristics of bistabiility, high contrast and high color saturation. The cholesteric liquid crystal display device only consumes power when changing displayed images, and the same displayed image can be displayed without applying external voltages. Characteristics of a cholesteric liquid crystal make the cholesteric liquid crystal suitable for reflective display devices. Hence, a reflective cholesteric liquid crystal display device excels in power consumption when displaying still images.

A distinct behavior of the bistable display device, taking the cholesteric liquid crystal display device as an example, is that the light valve layer is stably in either a planar state or a focal conic state. Please refer to FIG. 1. FIG. 1 is a diagram illustrating a light valve layer CLCL of a cholesteric liquid crystal display device. As shown in FIG. 1, a second substrate S2 is disposed below a first substrate S1, and the light valve layer CLCL is disposed in between the first substrate S1 and the second substrate S2. The second substrate S2 is disposed in between the light valve layer CLCL and a light absorption layer LAL, and the light absorption layer LAL is disposed below the second substrate S2. The light valve layer CLCL comprises a plurality of liquid crystals CLC. The light L passes through the light valve layer CLCL via the first substrate S1, and is then absorbed by the light absorption layer LAL through the second substrate S2. Amount of the light L reflected by the liquid crystals CLC corresponds to arrangement of the liquid crystals CLC, and affects how much light L is absorbed by the light absorption layer LAL. In the planar state, the liquid crystals CLC in the light valve layer CLCL are aligned, which corresponds to highest reflectivity. In the focal conic state, the liquid crystals CLC in the light valve layer CLCL are arranged orderlessly, which scatters the injected light L. Compared to the planar state, the focal conic state corresponds to a relatively lower reflectivity. Generally, the light valve layer CLCL displays the first state (e.g. the bright state) in the planar state, and displays the second state (e.g. the dark state) in the focal conic state. In addition, the light valve layer CLCL can also be in a transient state, which is the homeotropic state. In the homeotropic state, the liquid crystals CLC in the light valve layer CLCL are aligned vertically (parallel to the externally applied electrical field), so almost all of the light L can pass through the light valve layer CLCL and be absorbed by the light absorption layer LAL.

The state of the light valve layer of the cholesteric liquid crystal display device can be altered according to an electrical field applied to the light valve layer. Please refer to FIG. 2. FIG. 2 is a diagram illustrating changing the state of the light valve layer according to different electrical fields applied. In FIG. 2, an increase of the electrical field applied to the light valve layer is represented by "+", and a decrease of the electrical field applied to the light valve layer is represented by "−". As shown in FIG. 2, the light valve layer can be transformed to the focal conic state from the planar state by applying a relatively smaller electrical field (e.g. applying a voltage of approximately 5-20 volts). The light valve layer can be transformed to the homeotropic state from the planar state or the focal conic state by applying a relatively larger electrical field (e.g. applying a voltage approximately higher than 40 volts). If the applied electrical field is removed swiftly (e.g. applying a voltage of approximately 0-5 volts) when the light valve layer is in the homeotropic state, the light valve layer is transformed back to the planar state. If the applied electrical field is removed slowly when the light valve layer is in the homeotropic state, the light valve layer is transformed to the focal conic state. The light valve layer in the focal conic state can also transform to the focal conic state of an even lower reflectivity by applying the electrical field.

However, the light valve layer in the focal conic state cannot transform back to the planar state directly. The relatively larger electrical field must be applied to the light valve layer first to transform the light valve layer to the homeotropic state, then the applied electrical field is removed quickly for the light valve layer to transform back to the planar state. Further, if the light valve layer is to transform from a focal conic state of a lower reflectivity to a focal conic state of a higher reflectivity, the light valve layer must transform back to the planar state first through the homeotropic state, and then transform to the focal conic state of the higher reflectivity by applying an electrical field of corresponding magnitude.

In other words, for the reflective bistable display device, an image of high gray scale can be switched to low gray scale by applying voltages directly. However, for switching the image of low gray scale to high gray scale, the light valve layer must be reset back to the planar state first through the homeotropic state, and then a corresponding voltage is applied for the light valve layer to display the target gray scale from the planar state.

Therefore, reset must be performed by the reflective bistable display device when switching displayed images. Taking the cholesteric liquid crystal display device as an example, reset is performed by applying the relatively larger electrical field for the light valve layer to transform to the homeotropic state, then quickly removing the electrical field for the light valve layer to transform back to the planar state, so that a pixel can change from displaying a higher gray scale to a lower gray scale. Hence, when utilizing the conventional method to drive the bistable display device to play back videos or motion graphics, a higher number of frames is required to display each image. Consequently, a higher frame rate is required for the display panel.

SUMMARY OF THE INVENTION

The present invention discloses a driving method for a bistable display device. The driving method comprises when displaying a first frame, setting a first duration and a second duration according to a frame period of the first frame; applying a first voltage to alight valve layer in the first duration according to display data for the light valve layer to enter a second state from a first state; and applying a second voltage to the light valve layer in the second duration for the light valve layer to enter the first state.

The present invention further discloses a bistate display device. The bistate display device comprises a first substrate, a second substrate and a light valve layer. The second substrate is disposed below the first substrate. The light valve layer is disposed between the first substrate and the second substrate. Driving the light valve layer comprises: when displaying a first frame, setting a first duration and a second duration according to a frame period of the first frame; applying a first voltage to the light valve layer according to a display data in the first duration for the light valve layer to enter a second state from a first state; and applying a second voltage to the light valve layer in the second duration for the light valve layer to enter the first state.

These and other objectives of the present invention will no doubt become obvious to those of ordinary skill in the art after reading the following detailed description of the preferred embodiment that is illustrated in the various figures and drawings.

DETAILED DESCRIPTION

The concept of the present invention is explained below using different embodiments and corresponding figures.

A principle of the present invention is to utilize the homeotropic state of a light valve layer of a bistable display device as a second state, such as the dark state, and divide a frame period equally into a plurality of sub frame periods according to display data. A ratio of sub frame periods for displaying the first state to sub frame periods for displaying the second state is adjusted according to the display data, so as to display different gray scales in one frame period. The light valve layer of the bistable display device is transformed to the planar state in the last sub frame period of each frame period. This way, reset is not required when switching to a next frame. The following embodiments correspond to the bistable display device under normal conditions, and positive/negative voltage variations caused by fine-tuning the display driving voltage due to process variation are not considered.

Figure 1:
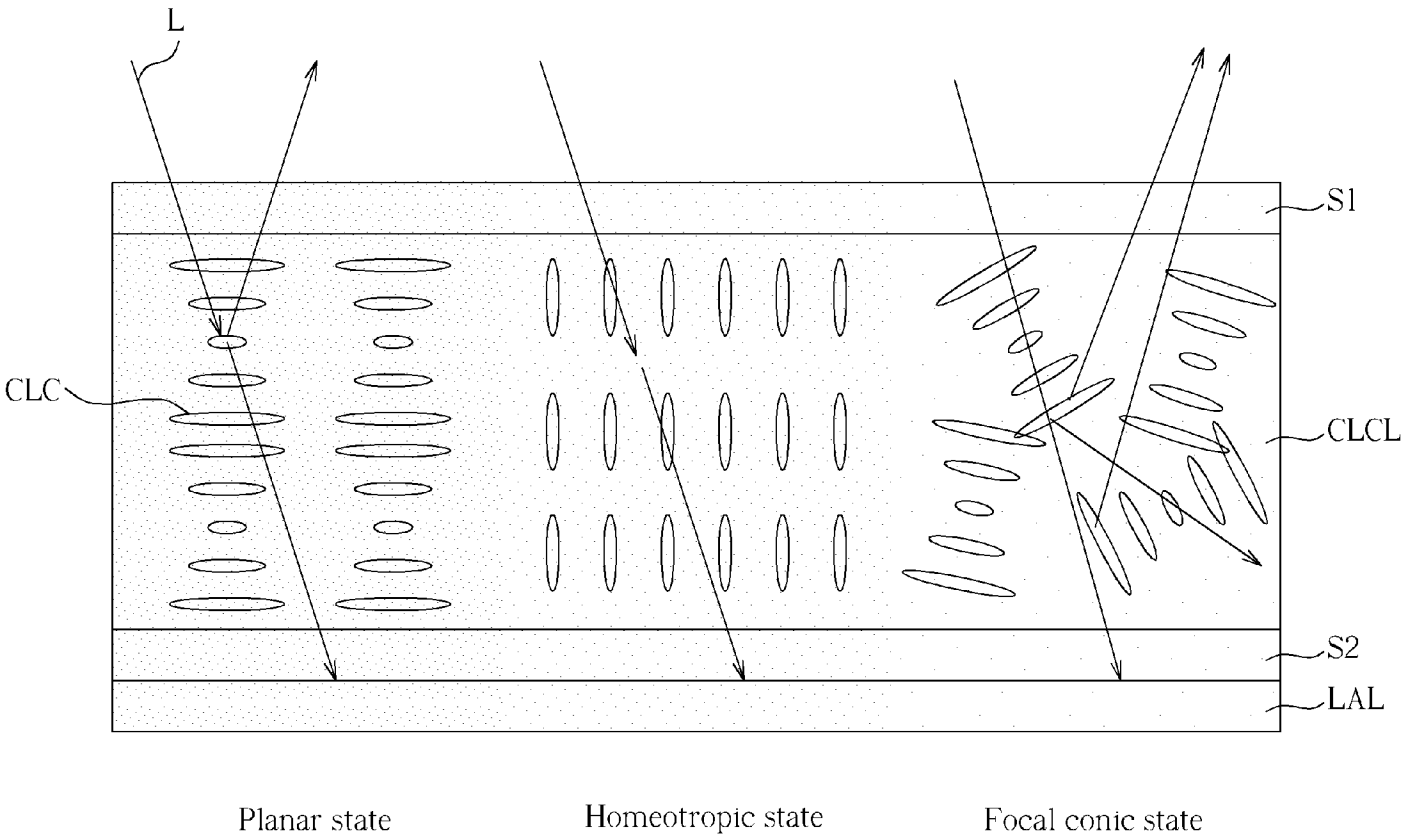
FIG. 1 PRIOR ART
FIG. 1 is a diagram illustrating a light valve layer of a cholesteric liquid crystal display device.
Figure 2:
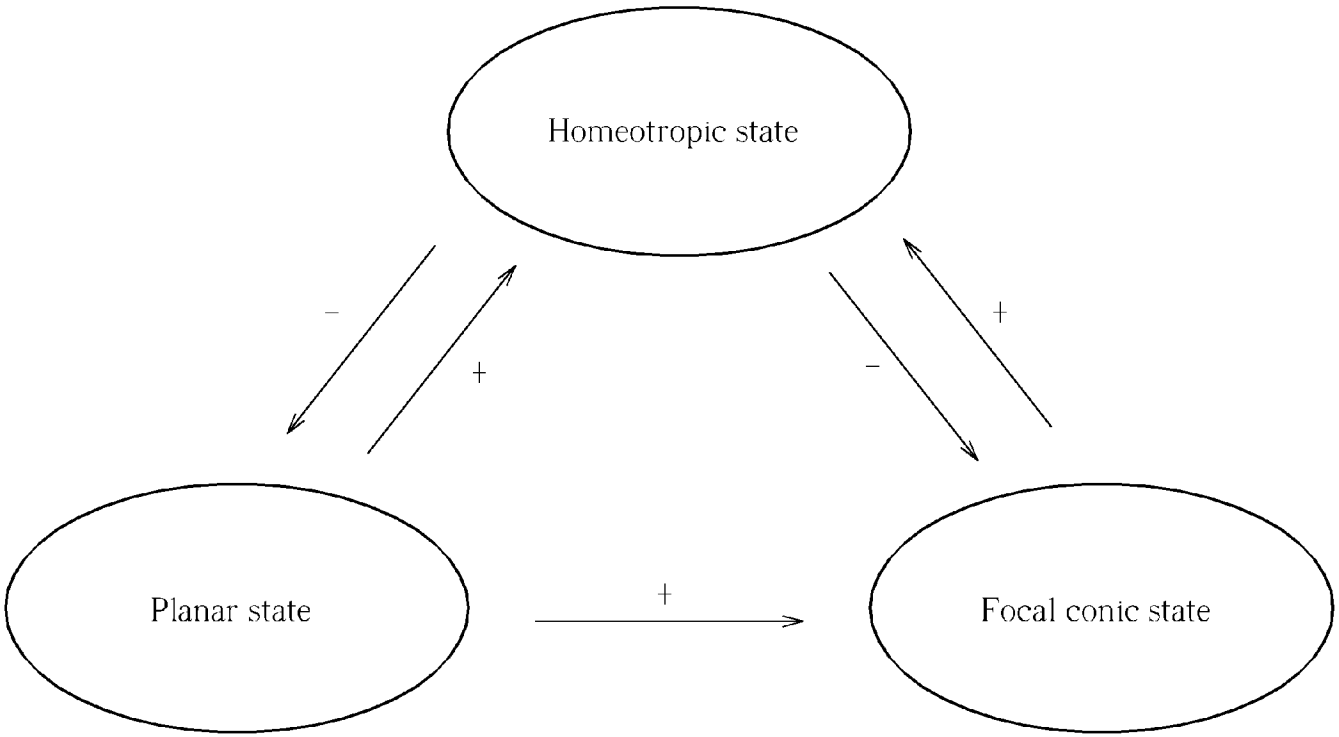
FIG. 2 PRIOR ART
FIG. 2 is a diagram illustrating changing the state of the light valve layer according to different electrical fields applied.

Please refer back to FIG. 1. In the homeotropic state the liquid crystals CLC are pulled vertically for the light valve layer CLCL to be almost transparent. Almost all of the light L injected is able to pass through the light valve layer CLCL, and is absorbed by the light absorption layer LAL below the light valve layer CLCL. Generally, the light absorption layer LAL disposed below the light valve layer CLCL of the bistable display device is black, so the bistable display device in the homeotropic state can achieve a reflectivity that is lower than when the bistable display device is in the focal conic state. In the present invention, the bistable display device utilizes the homeotropic state of the light valve layer CLCL to be the second state, which is the dark state, to obtain better contrast.

Figure 3:
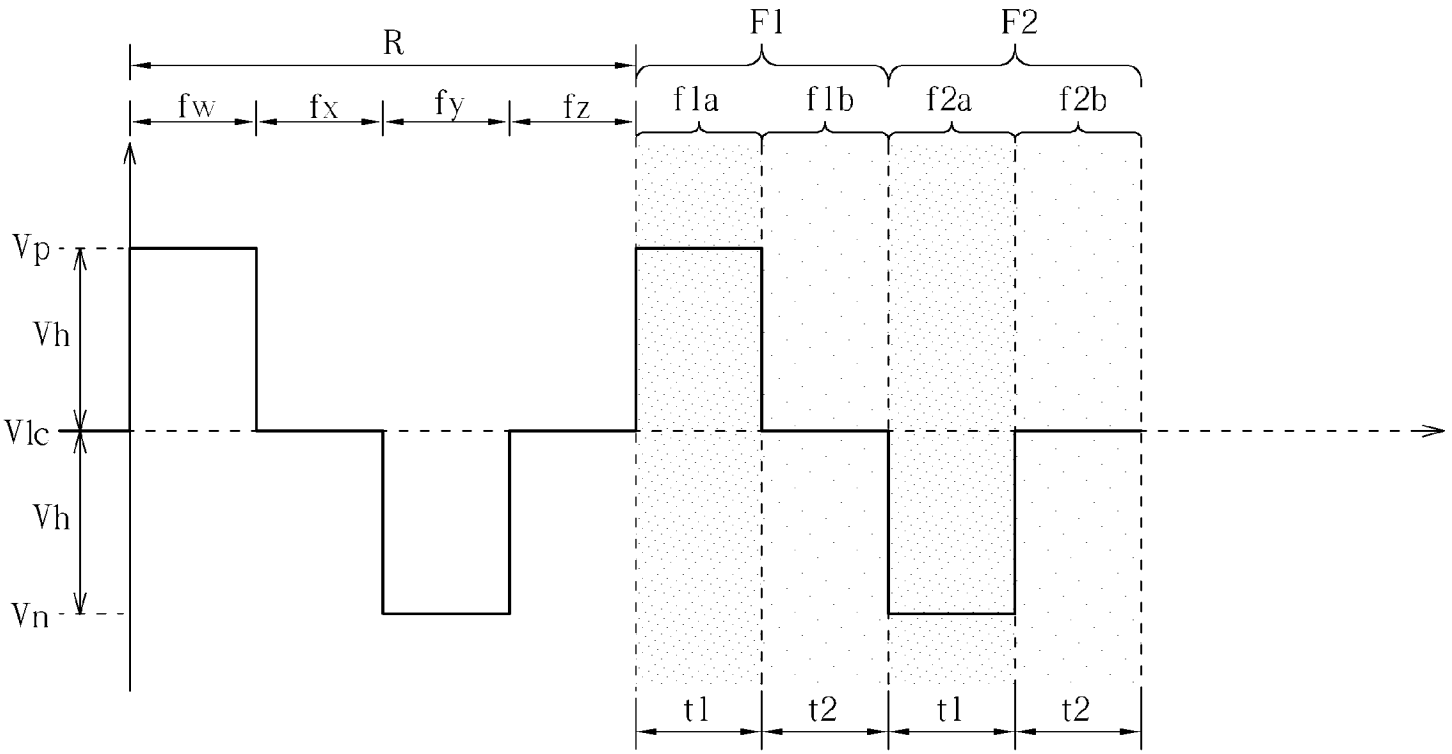
FIG. 3 is a diagram illustrating a driving method of the present invention in which the bistable display device is driven to display a one-bit gray scale according to an embodiment of the present invention.

Please refer to FIG. 3. FIG. 3 is a diagram illustrating a driving method of the present invention in which the bistable display device is driven to display a one-bit gray scale according to an embodiment of the present invention. The bistable display device performs a reset step R before starting to display images (e.g. when starting up the bistable display device) according to display data. In the reset step R, the bistable display device first applies a high voltage Vp to the light valve layer for a duration fw for entering the homeotropic state. Since driving with alternating current (AC) is less likely to cause ion residue issues, the bistable display device applies the driving voltage to the light valve layer by alternating positive and negative half cycles in the present embodiment. In other words, after the duration fw, the bistable display device applies a high voltage Vn for a duration fy, where the high voltages Vn and Vp comprise the same voltage magnitude Vh as a low voltage Vlc, but with opposite polarities. In theory, after applying the high voltage Vp for the duration fw, the bistable display device can apply the high voltage Vn directly, but practically such action may cause abnormal operation. Hence, in between durations fw and fy, the bistable display device pulls the applied voltage to the low voltage Vlc first for a duration fx. After the light valve layer is in the homeotropic state for the duration fy, the bistable display device then quickly reduces the voltage to the low voltage Vlc for a duration fz, for the light valve layer to be in the planar state. This way, the bistable display device completes the reset step R. Generally, the high voltage Vp is approximately 40 volts (V), and the low voltage Vlc is approximately 0-5V. Durations fw, fx, fy and fz comprise the same time duration. A voltage difference of voltage magnitude Vh exists between the high voltage Vp and the low voltage Vlc, and between the high voltage Vn and the low voltage Vlc.

After the reset step R is completed, the bistable display device displays a first frame in a first frame period F1 according to the display data. A frame, for instance, can be one of many single images in a video. The bistable display device sets a first duration t1 and a second duration t2 according to duration of the first frame period F1. In the present embodiment, the bistable display device utilizes two sub frame periods f1*a* and f1*b* to display the one bit gray scale, where the sub frame period f1*a* corresponds to the first duration t1 and the sub frame period f1*b* corresponds to the second duration t2. In the first duration t1, the bistable display device can either apply the high voltage Vp or the low voltage Vlc to the light valve layer. In the second duration t2, the bistable display device constantly applies the low voltage Vlc to the light valve layer for keeping the light valve layer in the planar state. Since the bistable display device displays the one-bit gray scale in the present embodiment, the voltage applied by the bistable display device to the light valve layer in the first duration t1 determines the first frame to be high gray scale or low gray scale. For instance, if the bistable display device applies the high voltage Vp in the first duration t1, the light valve layer is transformed to the homeotropic state (e.g. low reflectivity) to display a low gray scale. If the bistable display device applies the low voltage Vlc in the first duration t1, the light valve layer stays in the planar state (e.g. high reflectivity) to display a high gray scale.

To achieve AC driving, a polarity of the voltage applied by the bistable display device to the light valve layer when displaying a next frame is opposite to a polarity of the voltage applied by the bistable display device to the light valve layer when displaying a current frame. Assume the bistable display device displays a low gray scale for the first and second frames in the first and second frame periods F1 and F2, respectively. For the first frame period F1, as shown in FIG. 3, the bistable display device applies the high voltage Vp in the sub frame period f1*a*, which corresponds to the first duration t1, for the light valve layer to transform to the homeotropic state having low reflectivity. The bistable display device applies the low voltage Vlc in the sub frame period f1*b*, which corresponds to the second duration t2, for the light valve layer to transform to the planar state. Since the bistable display device still displays the low gray scale in the second frame period F2, the bistable display device applies the high voltage Vn in a sub frame period f2*a* of the second frame period F2, for the light valve layer to transform to the homeotropic state having low reflectivity. In a sub frame period f2*b* which corresponds to a second duration t2 of the second frame period F2, the bistable display device applies the low voltage Vlc for the light valve layer to transform to the planar state. The high voltages Vn and Vp comprise the same voltage magnitude Vh as the low voltage Vlc but with opposite polarities.

Since the bistable display device constantly applies the low voltage Vlc in the second duration of the first frame period F1, the light valve layer is already in the planar state prior to displaying the next frame (e.g. prior to displaying the second frame in the second frame period F2), hence the reset step is not required to be repeated again.

Figure 4:
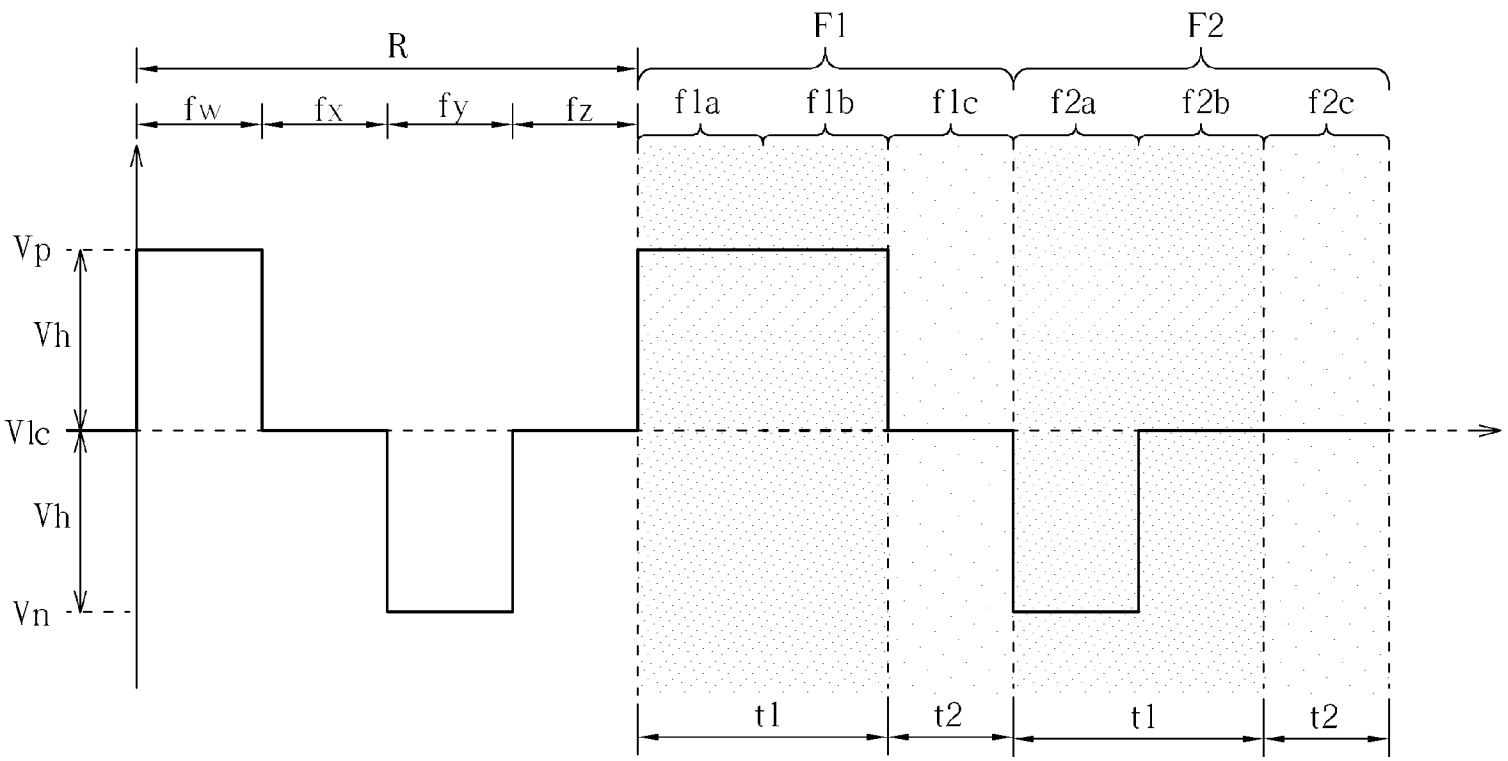
FIG. 4 is a diagram illustrating driving the bistable display device to display a plurality of gray scales according to an embodiment of the driving method of the present invention.
Figure 5:
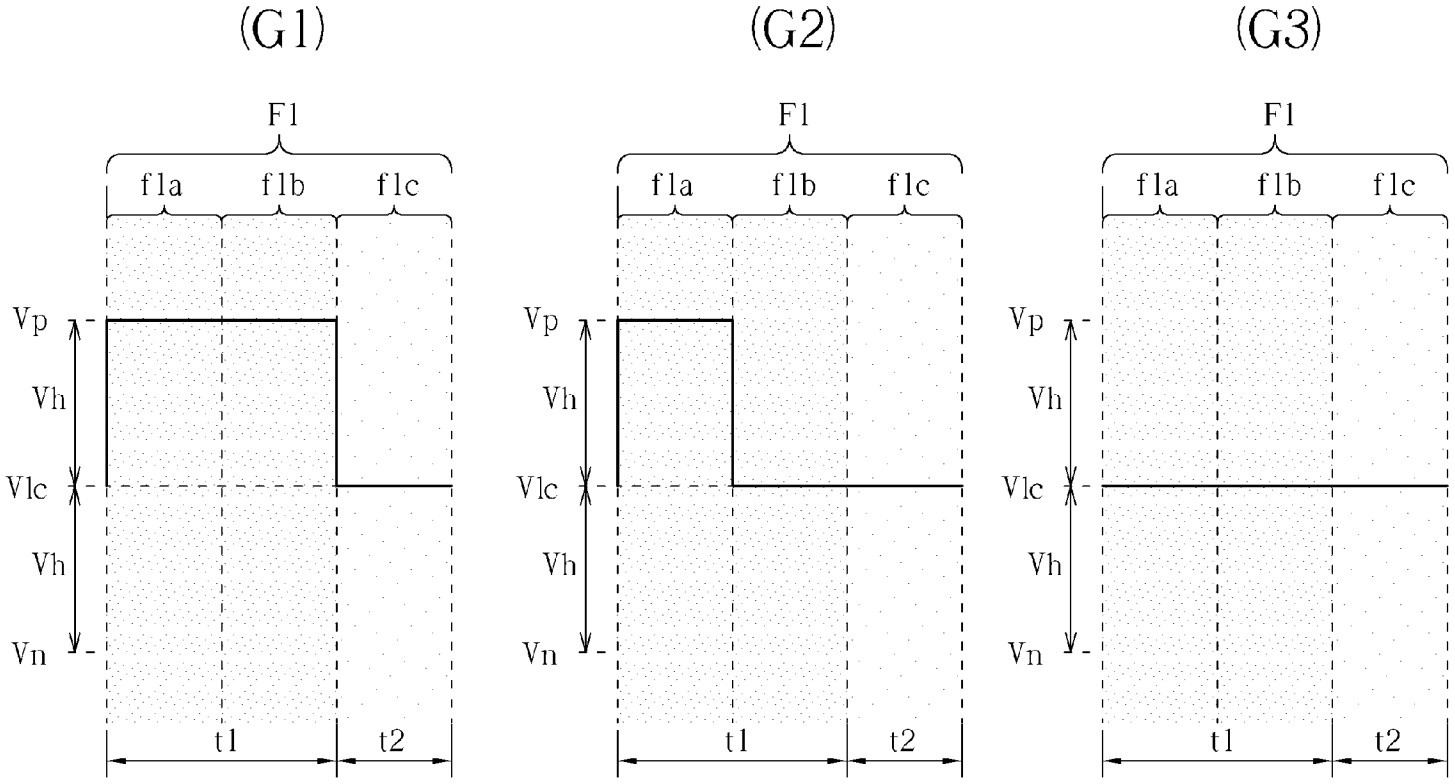
FIG. 5 is a diagram illustrating driving the bistable display device to display three gray scales in one frame through the driving method of the present invention.

Please refer to FIG. 4 and FIG. 5. FIG. 4 is a diagram illustrating driving the bistable display device to display a plurality of gray scales according to an embodiment of the driving method of the present invention. FIG. 5 is a diagram illustrating driving the bistable display device to display three gray scales in one frame through the driving method of the present invention. Taking displaying three gray scales as an example, as shown in FIG. 4, the bistable display device sets a first duration t1 and a second duration t2 according to duration of the first frame period F1. The bistable display device sets a number of sub frame periods in the first duration and the second duration according to the display data. The bistable display device also adjusts a ratio of the first duration and the second duration in each frame period according to the display data.

In the present embodiment, the bistable display device utilizes three sub frame periods f1*a*, f1*b* and f1*c* to display three gray scales, where sub frame periods f1*a* and f1*b* correspond to the first duration t1, and the sub frame period f1*c* corresponds to the second duration t2. By applying the high voltage indifferent numbers of sub frame periods in the first duration of a frame period, and constantly applying the low voltage in the second duration in the frame period, the bistable display device can drive the light valve layer to display a plurality of gray scales without being required to repeat the reset step when displaying a next frame.

As shown in FIG. 5, when the bistable display device applies the high voltage Vp to the light valve layer in sub frame periods f1*a* and f1*b*, the light valve layer displays a grayscale G1. When the bistable display device applies the high voltage Vp to the light valve layer only in sub frame period f1*a*, the light valve layer displays a grayscale G2. When the bistable display device applies the low voltage Vlc to the light valve layer in sub frame periods f1*a*, f1*b* and f1*c*, the light valve layer displays a grayscale G3.

For the embodiment shown in FIG. 4, the bistable display device displays the gray scale G1 in the first frame period F1 and displays the gray scale G2 in the second frame period F2. The operation principle of the reset step R shown in FIG. 4 is similar to the reset step R shown in FIG. 3, so the relative description is omitted hereinafter. For duration of the first frame period F1, the bistable display device applies the high voltage Vp in sub frame periods f1*a* and f1*b* of the first duration t1, and applies the low voltage Vlc in the sub frame period f1*c*, which is the second duration t2, for the light valve layer to display the gray scale G1 in the first frame period F1. For duration of the second frame period F2, the bistable display device applies the high voltage Vp in the sub frame period f2*a* of the first duration t1, and applies the low voltage Vlc in the sub frame period f2*b* and the second duration t2, for the light valve layer to display the gray scale G2 in the second frame period F2. Since the bistable display device constantly applies the low voltage Vlc in the second duration t2 of the first frame period F1, the light valve layer is already in the planar state prior to displaying the next frame (e.g. in the second frame period F2) and does not require performing the reset step R again.

In the first duration t1 of a frame period, when the bistable display device applies the high voltage Vp or Vn in a plurality of sub frame periods, the sub frame periods being applied with the high voltage Vp or Vn are continuous. For the light valve layer to be in the planar state prior to displaying the next frame, the bistable display device applies the low voltage Vlc in the last sub frame period, which corresponds to the second duration, of all frame periods. In the embodiment of the present invention, time durations of each sub frame period in one frame period are all equal to each other. For instance, sub frame periods f1*a*, f1*b*, f2*a* and f2*b* in FIG. 3 have the same time duration, and sub frame periods f1*a*, f1*b*, f1*c*, f2*a*, f2*b* and f2*c* in FIG. 4 have the same time duration. Furthermore, since the lowest frame rate that is acceptable for the human eye is approximately 30 Hertz (Hz), the time duration for the driving method of the present invention to drive the bistable display device to display one frame, which is equivalent to a total duration of all sub frame periods corresponding to the one frame, needs to be less than approximately 33 milliseconds (1/30 Hz=0.0333 . . . seconds).

In summary, the driving method of the present invention drives the bistable display device to constantly apply the low voltage in the second duration of each frame period to force the light valve layer to transform to the planar state in the last sub frame period of each frame period. This way, the light valve layer is already at the planar state prior to switching to the next frame, so the reset step is not required when displaying the next frame. The bistable display device is only required to perform the reset step once before displaying any frame. The bistable display device is not required to go through the reset step when switching different frames, hence reducing the total frame period required to display each frame.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving method for a bistable display device, comprising:

when displaying a first frame, setting a first duration of a first frame and a second duration of the first frame according to a frame period of the first frame;

applying a first voltage to a light valve layer in the first duration according to display data for the light valve layer to enter a second state from a first state for the bistable display device to display a dark image; and applying a second voltage to the light valve layer in the second duration for the light valve layer to enter the first state from the second state for the bistable display device to display a bright image;

wherein if the first voltage applied is a high voltage, sub frame periods in the first duration in which the first voltage is applied are continuous, and a reset is not required when switching to a next frame, thereby reducing voltage variations and saving power consumption.

2. The driving method of claim 1, further comprising:

adjusting a ratio of the first duration and the second duration in the frame period according to the display data.

3. The driving method of claim 1, further comprising:

when displaying a second frame, setting a third duration and a fourth duration according to a frame period of the second frame;

applying a third voltage to the light valve layer in the third duration for the light valve layer to enter the second state from the first state, wherein a magnitude of the third voltage is the same as the first voltage and a polarity of the third voltage is opposite to the first voltage; and applying the second voltage to the light valve layer in the fourth duration for the light valve layer to enter the first state.

4. The driving method of claim 3, further comprising:

performing a reset step when starting the bistable display device.

5. The driving method of claim 4, wherein performing the reset step comprises:

applying the first voltage to all light valve layers;

applying the second voltage to all light valve layers; and applying the third voltage to all light valve layers.

6. The driving method of claim 1, wherein the first duration comprises at least one sub frame period and the second duration comprises at least one sub frame period.

7. The driving method of claim 6, further comprising:

setting a number of sub frame periods in the first duration and the second duration according to the display data.

8. The driving method of claim 1, wherein a ratio of the first duration and the second duration in the frame period is adjusted according to the display data.

9. A bistate display device, comprising:

a first substrate;

a second substrate, disposed below the first substrate; and a light valve layer, disposed between the first substrate and the second substrate, wherein driving the light valve layer comprises:

when displaying a first frame, setting a first duration of the first frame and a second duration of the first frame according to a frame period of the first frame;

applying a first voltage to the light valve layer according to a display data in the first duration for the light valve layer to enter a second state from a first state for the bistable display device to display a dark image; and applying a second voltage to the light valve layer in the second duration for the light valve layer to enter the first state from the second state for the bistable display device to display a bright image;

wherein if the first voltage applied is a high voltage, sub frame periods in the first duration in which the first voltage is applied are continuous, and a reset is not required when switching to a next frame, thereby reducing voltage variations and saving power consumption.

10. The bistable display device of claim 9, wherein the bistable display device comprises an electrophoretic display device or a cholesteric liquid crystal display device.

11. The bistable display device of claim 9, wherein the first duration of the first frame is before the second duration of the first frame, and the second duration of the first frame is a last duration of the first frame.

12. The driving method of claim 1, wherein the first duration of the first frame is before the second duration of the first frame, and the second duration of the first frame is a last duration of the first frame.

* * * * *